US006374732B1

(12) United States Patent
Perretta

(10) Patent No.: US 6,374,732 B1
(45) Date of Patent: Apr. 23, 2002

(54) DAMPENER FOR USE IN LITHOGRAPHIC PRESSES

(76) Inventor: Frank Perretta, 32-3 Mt. Rose Rd., Marlboro, NY (US) 12542

( * ) Notice: Subject to any disclaimer, the term of this patent is extended or adjusted under 35 U.S.C. 154(b) by 0 days.

(21) Appl. No.: 09/587,504

(22) Filed: Jun. 5, 2000

(51) Int. Cl.[7] ..... B41F 7/30
(52) U.S. Cl. ..... 101/148; 101/147; 101/DIG. 38
(58) Field of Search ..... 101/147, 148, 101/DIG. 38

(56) References Cited

U.S. PATENT DOCUMENTS

| | | | | | |
|---|---|---|---|---|---|
| 1,294,961 | A | * | 2/1919 | Shultz | 101/DIG. 38 |
| 1,438,408 | A | | 12/1922 | Strawn et al. | 101/148 |
| 2,622,520 | A | | 12/1952 | Hauser et al. | 101/147 |
| 2,689,523 | A | | 9/1954 | Koch et al. | 101/147 |
| 3,143,065 | A | | 8/1964 | Warczak et al. | 101/147 |
| 3,411,718 | A | * | 11/1968 | Wagner | 101/147 |
| 3,902,416 | A | * | 9/1975 | Lake | 101/148 |
| 3,924,531 | A | * | 12/1975 | Klingler | 101/147 |
| 3,990,365 | A | | 11/1976 | Paulson et al. | 101/147 |
| 4,010,686 | A | | 3/1977 | Harris et al. | 101/148 |
| 4,044,674 | A | * | 8/1977 | Smith, Jr. | 101/148 |
| 4,188,882 | A | | 2/1980 | Jeschke et al. | 101/148 |
| 5,036,761 | A | | 8/1991 | Wingo et al. | 101/148 |
| 5,797,983 | A | | 8/1998 | Boelkins | 118/683 |

FOREIGN PATENT DOCUMENTS

| | | | | |
|---|---|---|---|---|
| DE | 880309 | | 6/1953 | |
| FR | 1049303 | * | 12/1953 | 101/147 |
| FR | 1141751 | * | 9/1957 | 101/147 |

* cited by examiner

*Primary Examiner*—Stephen R. Funk
(74) *Attorney, Agent, or Firm*—Joseph L. Spiegel

(57) ABSTRACT

A dampener for use in dampening the distribution roller of a printing press of the lithographic type includes: a hollow, perforated roller adjacent to the distribution roller; a dampening solution source containing dampening solution; a variable speed power mechanism for driving the perforated roller through the dampening solution source; an air source for blowing dampening solution obtained from the source onto the distribution roller; and an oscillator for oscillating the perforated roller laterally of the air source as the perforated roller is being rotated.

9 Claims, 3 Drawing Sheets

DAMPENER FOR USE IN LITHOGRAPHIC PRESSES

BACKGROUND OF THE INVENTION

1. Field of the Invention

This invention relates to printing presses such as those of the lithographic type and in particular to means for dampening the distribution roller of such presses.

2. Description of the Prior Art

The prior art discloses various systems for depositing a dampening solution onto the distributor roller of a printing press.

Strawn, U.S. Pat. No. 1,438,408 discloses a moisture supplying device for a lithographic printing machine. Strawn's primary moisture roller is a perforated drum covered with absorbent material. Water is dispersed to the interior of the drum through the apertures and into the absorbent material to be transferred to the surfaces to be dampened. Strawn does not use air to transfer fountain solution to a distributor roller, the moisture roller does not oscillate and it is not a non-contact dampening system.

In Hauser, U.S. Pat. No. 2,622,520, compressed air is blown through a continuously wetted sieve and then a slot for moistening the printing plates. The action is not rotary and, therefore, not continuous. Large amounts of over-spray would be produced.

Koch, U.S. Pat. No. 2,689,523 utilizes a radially perforated, continuously wet hollow cylinder through which compressed air is blown, for moistening an adjacent roller. A shield is positioned between cylinder and roller to ward off unwanted compressed air. The cylinder is not oscillated.

In Warozak, U.S. Pat. No. 3,143,065, the dampening unit includes a cylindrical screen which is rotated through the fountain solution. The unit further includes a cylindrical manifold with an air discharge slot for blowing air onto the screen and discharging solution therefrom onto a printing surface plate.

Paulson, U.S. Pat. No. 3,990,365 discloses a device for moistening the plate cylinders of offset printing machines. An inner rotatable sleeve provides air through radial air passages towards a fixed outer cylinder with spaced apertures. Dampening fluid is fed through gravity onto the outer cylinder. The rotatable inner sleeve forces air outward to direct the fluid to a diffuser which breaks the stream into a spray which in turn is directed to a dampening cylinder.

Harris, U.S. Pat. No. 4,010,686 describes a dampening device for a lithographic offset rotary printing press in which a cylindrical roller, which is in contact with a dampening fluid reservoir, has an apertured peripheral wall. Air jets from a fixed interior flow tube direct air towards the interior wall of the roller and through the apertures, directing the fluid on the roller fluid toward another roller.

Jeschke et al., U.S. Pat. No. 4,188,882 disclose a dampening unit for offset printing machines in which a screen cylinder receives dampening medium from one cylinder and delivers it to another. The screen cylinder is a perforated tube covered by a mesh fabric blanket for carrying the dampening medium. The screen cylinder is mounted on a blow tube disposed eccentrically to the axis of rotation of the screen cylinder and is provided with jet orifices adjacent to the screen cylinder interior wall. A coaxial air supply tube supplies air to the blow tube through a series of orifices.

U.S. Pat. No. 5,036,761 to Wingo describes a press dampening apparatus that includes a water feed roller comprising a stainless steel cylindrical wall having a matrix of water feed apertures that direct water to water form rollers, the feed apertures having ball check valves which are opened through contact with the water form rollers.

Boelkins, U.S. Pat. No. 5,797,983 pertains to a contact lubricator utilizing a perforated roller to allow liquid to migrate to an absorbent material. The liquid is forced through the perforations under pressure. The absorbent material comes in direct contact with the surface to be lubricated.

Koch, German Pat. No. 880,309 discloses a dampening unit comprising a rotating screen cylinder which dips into a fluid supply tank, absorbing liquid into the screen mesh of the cylinder. Compressed air from the inside of the cylinder blows the liquid out, spraying it onto an adjacent roller.

SUMMARY OF THE INVENTION

An object of the invention is a non-contact dampening means for a printing press of the lithographic type.

Another object is such a means that can be retrofitted to any lithographic printing press.

Still another object is such a means that uses low pressure air for transfer of dampening solution from the dampening means to the distribution roller of a lithographic printing press.

A further object is such a means that produces consistent and even transfer of dampening solution to the press distributor roller.

These and other objects, features and advantages are accomplished in accordance with the teachings of the present invention, one illustrative embodiment of which comprises a dampening means for use in dampening the distribution roller of a printing press of the lithographic type that includes: a hollow, perforated roller adjacent to the distribution roller; a dampening solution source, containing dampening solution, a variable speed power mechanism for driving the perforated roller through the dampening solution source; an air source for blowing dampening solution obtained from the source onto the distribution roller and an oscillator for oscillating the perforated roller, laterally of the air source as the perforated roller is being rotated.

BRIEF DESCRIPTION OF THE DRAWING

Other objects and advantages of the invention will be apparent from the following detailed description and accompanying drawing wherein.

DETAILED DESCRIPTION

Figure 1:
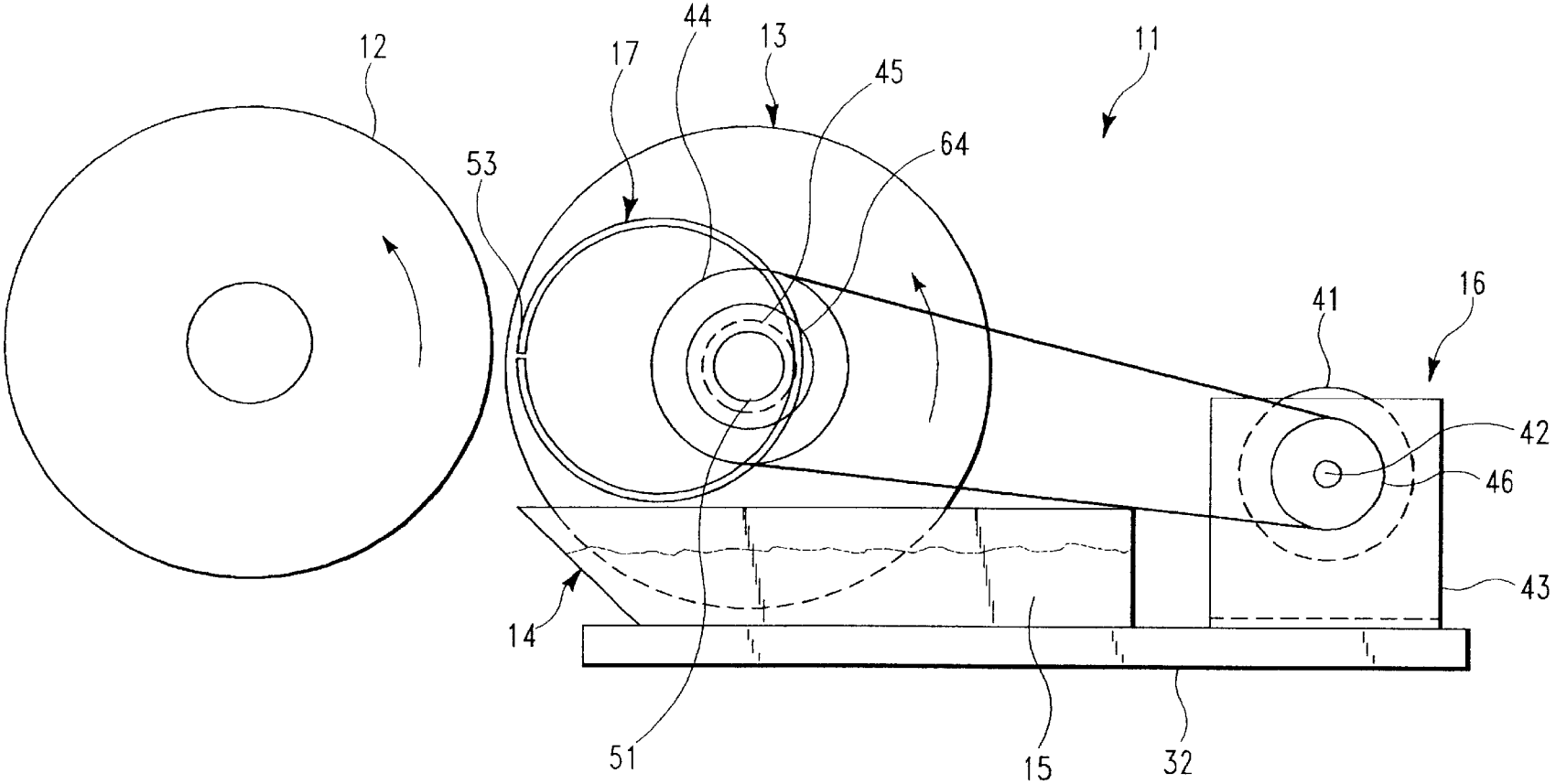
FIG. 1 is a side view partly schematic and partly in phantom of the dampening means of the present invention.

Referring now to FIG. 1 of the drawing, the dampener 11 of the present invention for use in dampening the distribution roller 12 of a printing press of the lithographic type is illustrated. The dampener 11 is seen as including: a perforated roller 13 adjacent to the distribution roller 12; a dampening solution source 14 containing dampening solution 15; a variable speed power mechanism 16 for driving the perforated roller 13 through the dampening solution source 14; an air source 17 for blowing dampening solution 15 obtained from source 14 onto the distribution roller 12; and an oscillator 18 (FIG. 2) for oscillating the perforated roller 13 laterally of the air source 17 as the perforated roller 13 is being rotated.

Figure 2:
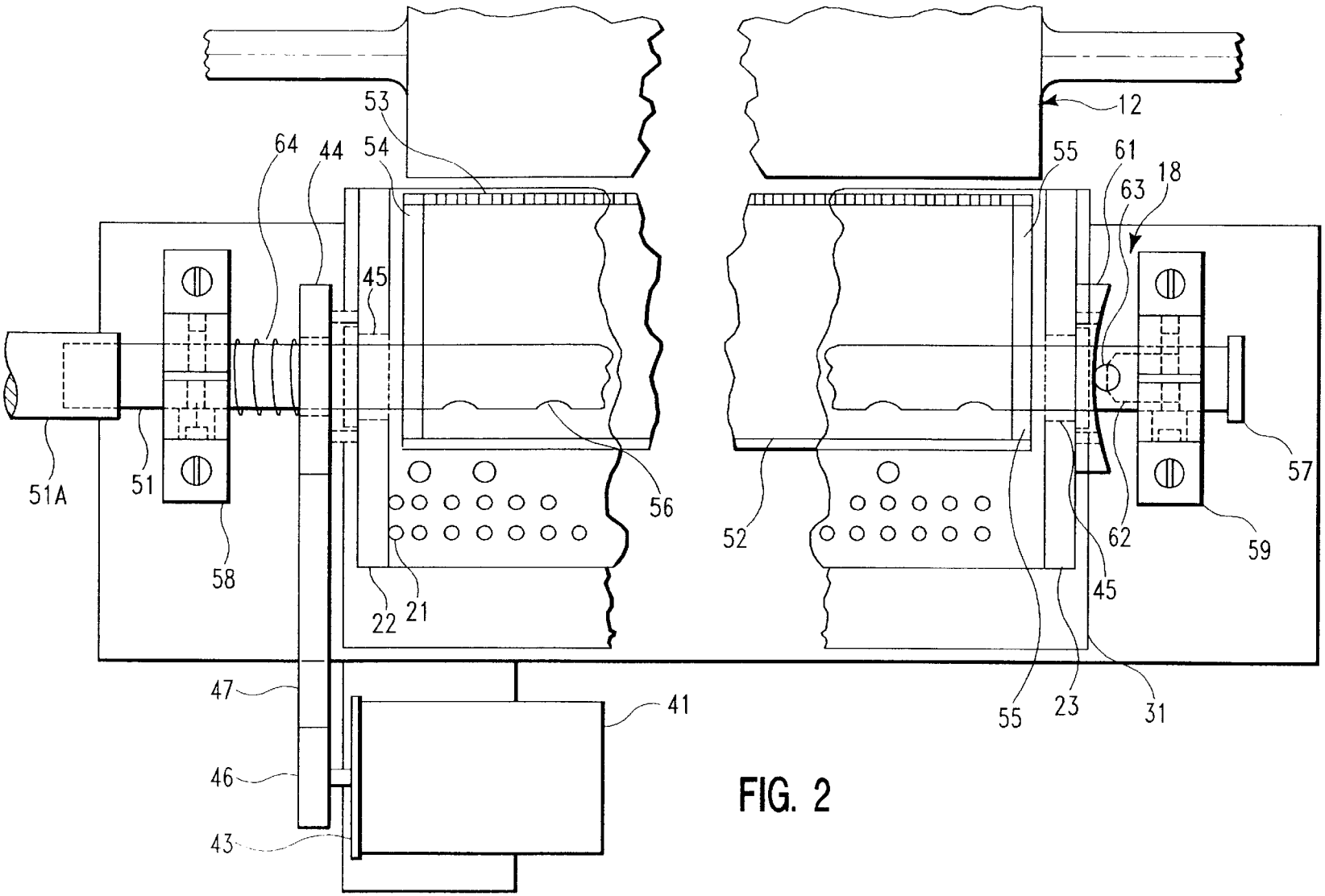
FIG. 2 is a top view of the dampening means of the present invention partly broken away and partly in phantom; and, FIG. 3 is a side view partially broken away and partly in phantom primarily of the oscillating means of the present invention.

The roller 13, as best seen in FIG. 2, is of stainless steel having a wall thickness of 0.030 inches to 0.060 inches and is approximately 4.5 inches in diameter, but can vary down to 3 inches or less to suit specifications. Perforations 21 through the roller are typically of 0.156 inches diameter and spaced 0.1875 inches apart, providing an open area to the curved surface of the roller 13 of approximately 63%. The roller is terminated with end plates 22, 23.

Dampening solution source 14 (FIG. 2) comprises simply a pan 31 mounted on a base 32 containing dampening solution 15. Commonly, the dampening solution 15 is an acidic solution (typical PH value 4.5) containing gum arabic, or simply water.

The power mechanism 16 includes a variable speed motor 14 with shaft 42 held within a motor bracket 43 mounted on base 32. Mechanism 16 further includes a timing belt pulley 44 and bushing 45, motor drive pulley 46 mounted on shaft 42 and timing belt 47. Varying speed of the rotation of perforated roller 13 regulates the amount of dampening solution applied to distribution roller 12.

Nominal rotation of roller 13 is from 10 to 25 r.p.m. depending upon press speed. A fractional horsepower motor is all that is needed to drive the roller 13 since there is no contact with any press roller.

Referring to both FIGS. 1 and 2, air source 17 comprises stainless steel tube 51 leading from an air supply (not shown) via an air supply tube 51*a* and also acts as the shaft on which perforated roller 13 is mounted. A cylindrical air tube 52 is mounted eccentrically also on tube 51 and is provided with a line of air holes 53 across its length. Air tube 52 typically has a wall thickness of 0.06 inches and is provided with end plates 54, 55. The holes 53 can be 0.005 to 0.040 inches in diameter and are 0.15 inches apart. Stainless steel tube 51 is provided with air supply holes 56 within air tube 52 and a plug 57 at its distal end. Air tube 52 is positioned in very close proximity to the perforated roller 13 at the line of air holes 53, typically 0.125 to 0.375 inches.

Stainless steel tube 51 is supported on the base 32 at either end by pillow blocks 58, 59.

Figure 3:
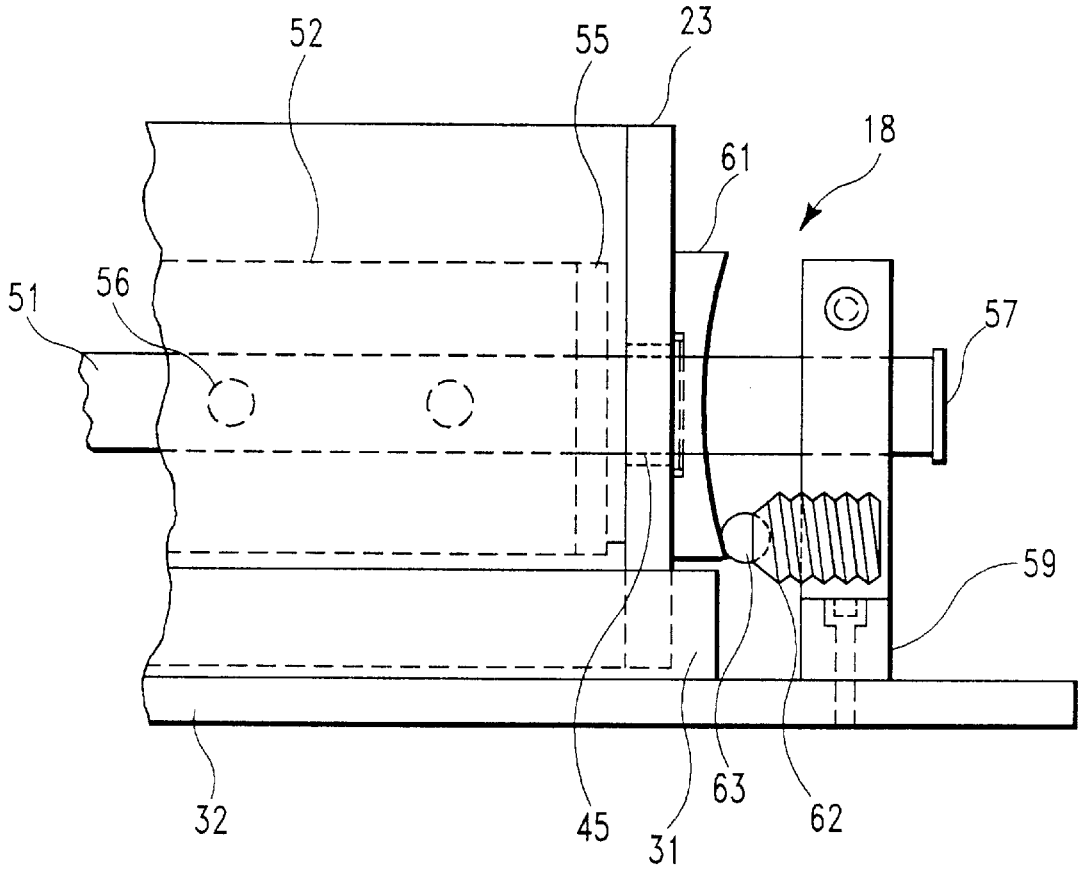

As best seen in FIGS. 2 and 3, oscillator 18 for oscillating the perforated roller 13 laterally of the air source 17 as the perforated roller 13 is being rotated comprises a cam 61 attached to end plate 23, a spring plunger 62 mounted in pillow block 59 with nylon ball 63 in contact with cam 61 to move the roller 13 laterally and a spring 64 mounted at the opposite end of tube 51 for urging the roller 13 in the opposite direction towards spring plunger 62.

The cam is cut to have two ¼ inch to ⅜ inch high lobes. For every revolution of the perforated roller 13, it will move two times laterally.

The oscillating action moves the perforated roller 13 laterally back and forth allowing the perforations 21 in the roller 13 to change position relative to the air holes 53 in the air tube 52 as roller 13 rotates. A nominal oscillating distance is 0.250 inches to 0.375 inches. The distance of lateral movement and frequency of oscillation can be tailored to the condition of each individual press.

The dampening means 11 is a non-contact system, that is, no direct contact between dampener and any press roller. Further, oscillation of roller 13 gives it the ability to transfer fluid evenly across the distribution roller 12.

The dampener uses low pressure air (2–4 psi, as measured at the air holes 53) to transfer dampening solution 15 from the perforated roller to the distribution roller 12.

The oscillating action of the perforated roller 13 coupled with the close proximity of air holes 53 to each other produce a very consistent and even transfer of dampening solution 15 to the distribution roller 12.

A problem with many prior art systems is over-spray, which may cause specks to appear on the printed page. Another problem with the spray is the clogging of nozzles. The very low pressure air used to transfer the dampening solution 15 to the distribution roller 12 in my invention eliminates the problems caused by over-spray and is permitted due to the 63% open area of roller 13 and its thin metal thickness.

It should be obvious that changes, additions and omissions may be in the details and arrangement of parts without departing from the scope of the invention, as hereinafter claimed.

What is claimed is:

1. A dampener for use in dampening a distribution roller of a printing press comprising:

a hollow, perforated roller adjacent the distribution roller;

a dampening solution source;

means for rotating the perforated roller through the dampening solution source;

an air source for blowing dampening solution from the perforated roller onto the distribution roller;

a cam mounted on one end of said perforated roller, a spring biased plunger engaging said cam, and a spring positioned at the opposite end of said perforated roller for uring the roller in a direction towards the spring biased plunger, whereby the perforated roller is oscillated laterally of the air source as the perforated roller is being rotated.

2. The dampener of claim 1, wherein the perforated roller has greater than 50% open area.

3. The dampener of claim 1, wherein the rotation means is driven by a variable speed motor to vary the amount of dampening solution applied to the distribution roller.

4. The dampener of claim 1, wherein the air source includes an axial tube on which the perforated roller is mounted.

5. The dampener of claim 4, wherein the air source includes a cylindrical air tube eccentrically mounted on the axial tube.

6. The dampener of claim 5, wherein the axial tube is provided with air holes within the air tube.

7. The dampener of claim 6, wherein the air tube is provided with a line of air holes across the length of the air tube positioned in close proximity to the perforated roller.

8. The dampener of claim 5, wherein the air tube is provided with a line of air holes across the length of the air tube positioned in close proximity to the perforated roller.

9. A dampener for use in a printing press comprising:

a perforated roller;

a source of dampening solution;

means for conducting dampening solution to the perforated roller;

means for rotating the perforated roller; and, a cam mounted on one end of said perforated roller, a spring biased plunger engaging said cam, and a spring positioned at the opposite end of said perforated roller for urging the roller in a direction towards the spring biased plunger whereby the perforated roller is oscillated laterally of the air source as the perforated roller is being rotated.

* * * * *